US007318282B2

(12) United States Patent
Pulte

(10) Patent No.: US 7,318,282 B2
(45) **Date of Patent: *Jan. 15, 2008**

(54) PULTRUDED TRIM MEMBERS

(75) Inventor: William J. Pulte, Bloomfield Hills, MI (US)

(73) Assignee: PN II, Inc., Bloomfield Hills, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/079,086

(22) Filed: Feb. 20, 2002

(65) Prior Publication Data

US 2002/0124485 A1 Sep. 12, 2002

Related U.S. Application Data

(60) Provisional application No. 60/274,808, filed on Mar. 9, 2001.

(51) Int. Cl.
*B29C 47/08* (2006.01)

(52) U.S. Cl. ..... 29/897; 29/897.3; 264/137; 52/288.1; 52/95; 52/745.19; 52/302.1; 52/58; 52/11

(58) Field of Classification Search ..... 52/94, 52/95, 96, 11, 15, 13, 58, 749.1, 749.19, 741.3, 52/745.07, 91.3, 287.1, 745.19, 302.1, 302.3, 52/288.1, 749.15, 741.1; 29/897.3, 897.32, 29/557, 509, 458, 897; 72/253.1, 467; 264/137
See application file for complete search history.

(56) References Cited

U.S. PATENT DOCUMENTS 292,486 A * 1/1884 Hayes ..... 52/16
435,906 A * 9/1890 Symonds ..... 52/96
2,896,559 A * 7/1959 Stephens ..... 52/94
3,024,573 A * 3/1962 McKinley ..... 52/96
3,201,910 A * 8/1965 Keesee ..... 52/287.1
3,344,562 A * 10/1967 Miles et al. ..... 52/11
3,344,563 A * 10/1967 Miles et al. ..... 52/11
3,826,048 A * 7/1974 Merkin et al. ..... 52/11
4,037,372 A * 7/1977 Patry ..... 52/96
4,053,447 A * 10/1977 Shea ..... 524/594
4,077,171 A * 3/1978 Simpson et al. ..... 52/96
4,092,808 A * 6/1978 Maloney et al. ..... 52/11

(Continued)

FOREIGN PATENT DOCUMENTS

JP 16659 * 1/1992 ..... 52/94

(Continued)

OTHER PUBLICATIONS

Information about Inventorship including correspondence with Inline (Exhibits A-E).

(Continued)

*Primary Examiner*—Lanna Mai
*Assistant Examiner*—Phi Dieu Tran A
(74) *Attorney, Agent, or Firm*—Dobrusin & Thennisch PC

(57) ABSTRACT

The present invention is an improved method of making cornice assemblies and other trim members utilizing the process of pultrusion. The cornice assemblies and the other trim members made by the method of the present invention exhibit superior strength to weight ratios, low expansion and contraction due to changes in temperature and humidity, as well being less labor intensive to install.

6 Claims, 8 Drawing Sheets

U.S. PATENT DOCUMENTS

| | | | | | |
|---|---|---|---|---|---|
| 4,226,056 | A | * | 10/1980 | Hallam | 52/11 |
| 4,262,459 | A | * | 4/1981 | Hallam | 52/11 |
| 4,347,691 | A | * | 9/1982 | Lloyd-Jones | 52/95 |
| 4,387,415 | A | * | 6/1983 | Domas | 362/479 |
| 4,610,412 | A | * | 9/1986 | Holden | 248/48.2 |
| 4,912,888 | A | * | 4/1990 | Martin | 52/12 |
| 4,956,950 | A | * | 9/1990 | Hilrose | 52/94 |
| 5,116,450 | A | | 5/1992 | Spoo et al. | |
| 5,198,172 | A | | 3/1993 | Spoo et al. | |
| 5,243,793 | A | * | 9/1993 | MacLeod et al. | 52/95 |
| 5,315,799 | A | * | 5/1994 | Cullinan | 52/288.1 |
| 5,537,785 | A | * | 7/1996 | Zaccagni | 52/11 |
| 5,560,158 | A | * | 10/1996 | Norton | 52/95 |
| 5,647,172 | A | | 7/1997 | Rokicki | |
| 5,657,585 | A | * | 8/1997 | Zaccagni | 52/94 |
| 5,729,933 | A | * | 3/1998 | Strength | 52/96 |
| 5,950,375 | A | * | 9/1999 | Zaccagni | 52/94 |
| 5,954,904 | A | | 9/1999 | Rokicki | |
| 5,988,074 | A | * | 11/1999 | Thoman | 105/404 |
| 6,098,344 | A | * | 8/2000 | Albracht | 52/12 |
| 6,314,704 | B1 | * | 11/2001 | Bryant | 52/745.1 |
| 6,393,773 | B1 | * | 5/2002 | Marks | 52/73 |
| 6,539,675 | B1 | * | 4/2003 | Gile | 52/96 |
| 6,837,007 | B2 | * | 1/2005 | Floyd et al. | 52/36.2 |

FOREIGN PATENT DOCUMENTS

| | | | | |
|---|---|---|---|---|
| JP | 52350 | * | 2/1992 | 52/95 |
| JP | 49952 | * | 2/1994 | 52/94 |
| JP | 307002 | * | 11/1994 | 52/94 |
| WO | WO 91/10034 | | 7/1991 | |

OTHER PUBLICATIONS

J-Channel Product Literature—Web site: www.allsco.com/Sidings/accessories.htm.

Martin, J. D. et al., "Pultrusion", In: Dostal, C.A., ed. Engineered Materials Handbook (1987 ed.), vol. 1, pp. 533-543.

Inline Brochure.

Inline Sovereign FG Brochure.

Amoco Isopolyester News (Winter 93) (pp. 1-8).

"10 Changes in the Window and Door Industry by 2000", Window & Door Fabricator (Dec./Jan. 1997).

Jervis, J., "Pultruded Fiberglass Lineals . . . , Mainstream or Specialty?". Window & Fabricator (Apr./May 1998)(pp. 48-52).

"Fiberglass Fever: Window Manufactures are Turning on to Composite Windows" (1996).

Pirwitz, David P., "Why Good Windows Go Bad and What the Industry is Doing About It", Fenestration (Nov./Dec. 1996).

Casselman, George, "Fibreglass Window Frames", Window World (Mar./Apr. 1998).

"Inline Fiberglass Ltd. Fiberglass Windows and Doors The Choice of the Informed", Hamilton & South Central Ontario Builder/Architect (Oct. 1998).

"Pultruded Composites . . . from Concept to Reality", by Pultrusion Industry Council of the Composites Institute, The Society of the Plastics Industry, Inc., date unknown.

"Composites: Inline Fiberlglass bids to be world leader in thinwall pultrusion", date unknown.

Update No. 445, by Jim Dulley (1998).

Heartland Products Directory and Specification Guide (Oct. 1999).

Alcoa Vinyl Siding and Soffit Specifications (2000).

Vinyl Soffit Literature.

Architectural Specifications—Vinyl, Revere Building Products (1999).

Pultrusion for Engineers, 2000 Woodhead Publishing Limited.

* cited by examiner

PULTRUDED TRIM MEMBERS

FIELD OF THE INVENTION

The invention relates to building structures, and more particularly to trim members for protecting, covering and decorating the area from the base of the roof to the upper portion of the outer wall of a building structure, such as a home or office or other commercial building, where the trim members are manufactured by pultrusion.

BACKGROUND OF THE INVENTION

In the United States, most residential or light weight-building systems employ wood or metal rafters, which extend from six to twenty-four inches beyond the outer wall. The outer wall is typically constructed of masonry or wood construction. Typically, the rafters and the sub-fascia (a member that connects the rafter ends together) support roof decking which forms the base of the roof. Shingles or other roofing materials cover the roof decking. Typically, the entire area from the lower edge of the roof decking to the upper portion of the outer wall of the building structure is covered with a cornice assembly, usually made of wood or wood covered with aluminum or vinyl. Aluminum or vinyl is a preferred material because of the high maintenance of wood trim pieces, which require repainting every few years (but in fact, vinyl cannot be painted at all). A fascia, usually the upper trim member of the cornice assembly, typically covers the sub-fascia or the outer portion of the rafter ends. This fascia protects the sub-fascia or rafter ends from the elements, and provides a decorative cover. The soffit, another trim member of the cornice, typically extends horizontally between the bottom inside edge of the fascia to the upper portion of the outer wall. The third trim member of the cornice assembly, known as the frieze, is a decorative member that starts at the soffit and runs down the outside surface of the top of the outer wall. The frieze is usually made of the same material as the fascia and soffit.

One problem associated with decorative and protective cornice assemblies is the labor required to install the several component parts, such as the fascia, the soffit, the frieze, and decorative moldings associated therewith. A second problem occurs when wood is used, which may rot and which requires regular repainting. A third problem is denting of aluminum products, and a fourth problem is expanding and contracting of aluminum and vinyl. Numerous fastening means, such as nails, staples, and the like must be used to attach the component parts together and/or to the building. This practice adds significant time and expense to the construction of a conventional building structure.

In addition, a problem associated with aluminum or vinyl cornice assemblies is the shearing of the fasteners used to fasten the cornice assembly or the enlarging of the holes created for fastening the assembly to the building structure. This shearing/enlarging problem is due to the relatively large amount of expansion and contraction due to temperature or moisture variations, which also causes buckling of the aluminum or vinyl material. As a result, the cornice assembly may become detached from the building structure or may appear warped.

In the past, a cornice assembly has had to be fabricated in place. Each portion of the cornice assembly is attached to the building individually. When a wood backing is used in conjunction with vinyl or aluminum assembly, yet another aspect of the assembly must be attached individually. This process is time-consuming, labor-intensive, and difficult to attain professional looking results.

A known method of manufacturing articles which have a lineal profile and a constant cross-section is called pultrusion. Pultrusion is the opposite of extrusion. It is a continuous pulling process in which rovings or strands of fibers are impregnated with resin and are then pulled through a heated die which cures the resin while also providing the cross-sectional shape to the piece. The cured piece is cut to length as it comes off the line. See, for example, "Pultrusion for Engineers" (Trevor F. Starr ed., CRC Press, 2000), which is hereby incorporated by reference. Pultruded material can be colored during manufacture, but unlike vinyl, also has surface that can accept and permanently retain paint.

Therefore, pultrusion is desirable to provide an improved method for the manufacture of the cornice assembly (or other trim members used in home construction), to protect the interface between the roof decking and the upper portion of the outer wall of a building structure. Pultrusion would provide a cornice assembly that minimizes structural instability by eliminating expansion and contraction of the cornice assembly and minimizes the use of fasteners while providing a less labor-intensive fabrication process. In addition, a pultruded cornice assembly is desirable to reduce production and labor costs, including the elimination of the need to paint the trim after assembly—although painting remains an option if color change is desired.

SUMMARY OF THE INVENTION

The present invention includes improved methods for fabricating cornice assemblies and other trim members used in house construction. The cornice assemblies and trim members are fabricated through a process of pultrusion. Improved cornice assemblies are disclosed, which include at least a fascia, a soffit and a frieze with crown molding, all of which may be integrated into a unitary structure. The improved cornice assemblies may be constructed from one, two or more trim members. Also disclosed is a method of trimming a building structure using the cornice assemblies and trim members made by pultrusion. The dies utilized in the pultrusion of the cornice assemblies and trim members are also disclosed.

DESCRIPTION OF THE PREFERRED EMBODIMENT

Figure 1:
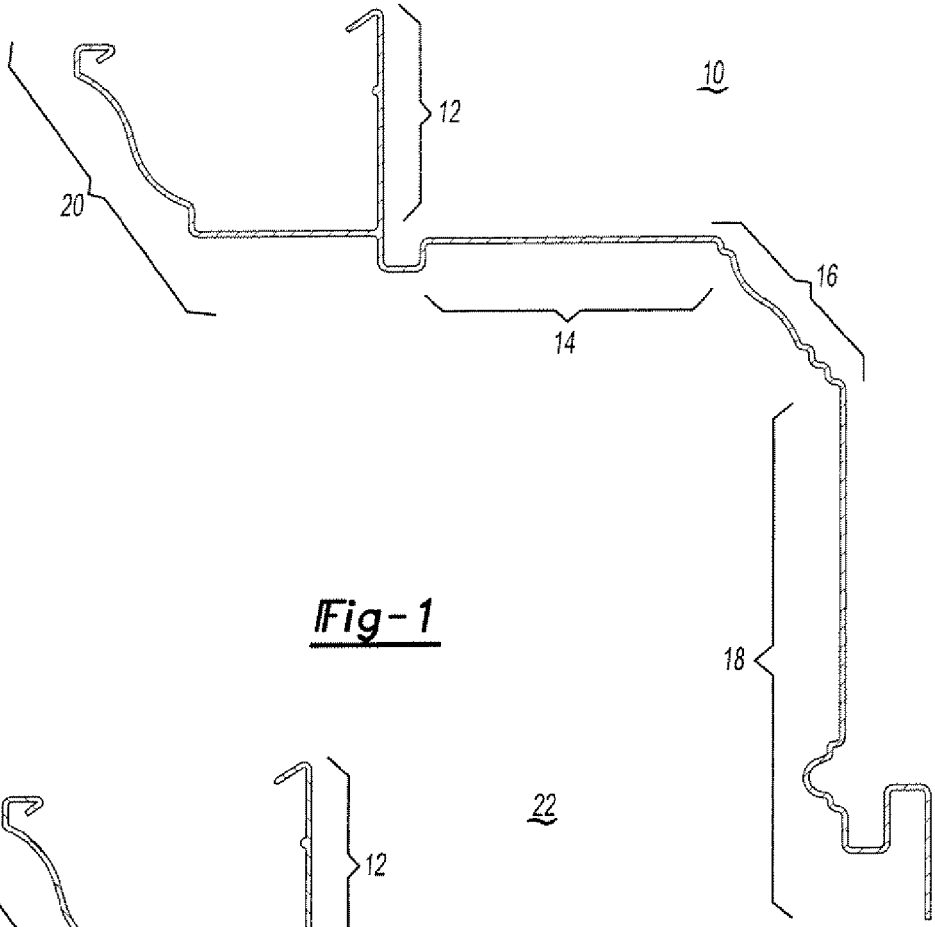
FIG. 1 is a cross-section of a cornice assembly made of a unitary construction which includes a facia, a soffit, a crown, a frieze and a gutter.

Referring now to FIG. 1, a cornice assembly 10 according to the invention is shown. The cornice assembly 10 includes portions a facia 12, a soffit 14, a crown 16, and a frieze 18. Optionally, the cornice assembly may also include a gutter 20 in which case the facia 12 forms the back side of the gutter 20.

A significant advantage may be gained through a unitary construction (formed as one piece) of the cornice assembly 10 in terms of the amount of labor needed to install the cornice assembly 10. With a unitary construction, effort need only be spent on attaching the cornice assembly 10 to the building structure, while effort spent on fabricating the cornice assembly 10 is completely eliminated.

The cornice assembly 10 may be used in with walls made of any suitable outer sheathing building material known in the art, such as plywood, fiber board, celotex, OSB (oriented strand board) and the like.

Figure 2:
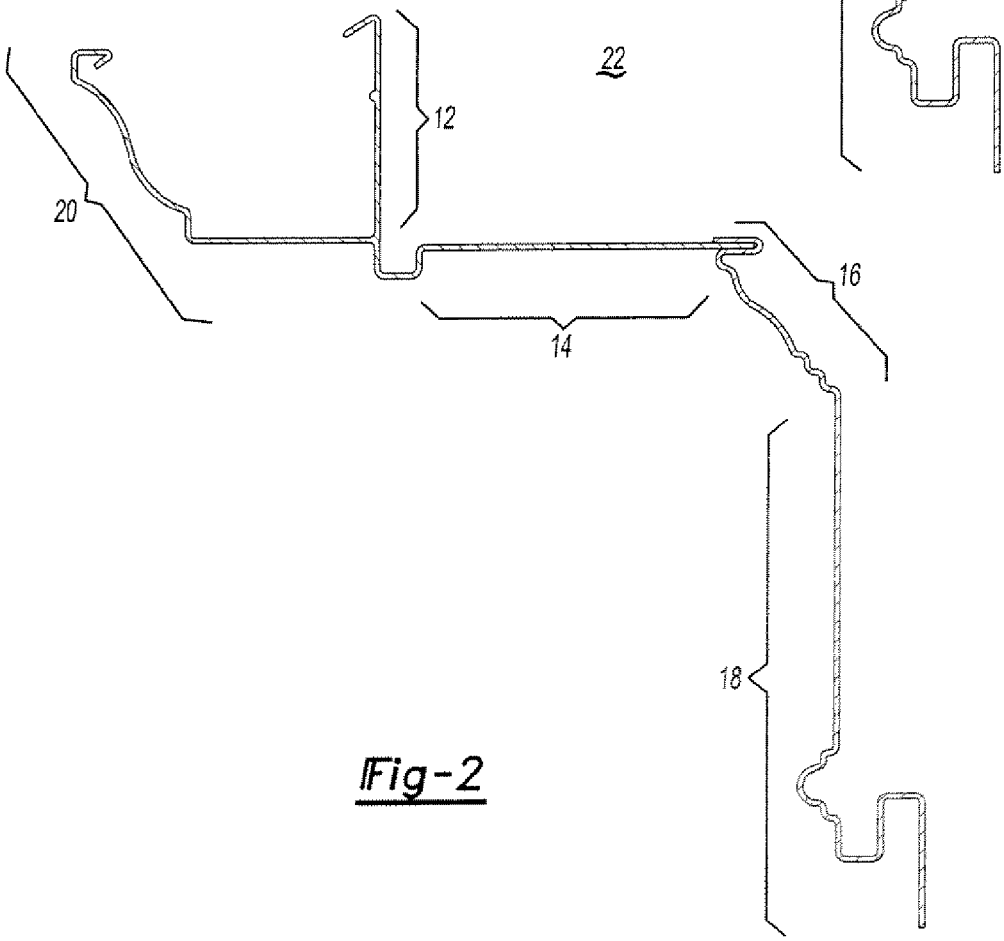
FIG. 2 is a cross-section of a cornice assembly made of two trim members.

In a second embodiment, as best seen in FIG. 2, the cornice assembly 22 may be made of two or more trim members which are connected together to form the overall cornice assembly 22. For example, one trim member may comprise the gutter 20, the facia 12 and the soffit 14, while another trim member includes the crown 16 and the frieze 18. In this embodiment, the trim members are preferably constructed such that they may be press fit together. However, any suitable means of connecting the trim members to form the cornice assembly 22 may be used, including adhesives, bolts, nails or screws. By using press fit connections, the effort of fabricating the cornice assembly 22 on the job site is reduced as compared to traditional cornice assemblies. First, trim members capable of being press fit can be connected without the use of tools. Second, because press fitting connections are separate from the means for attaching the cornice assembly 22 to the building structure, the cornice assembly 22 can be fabricated at ground level as opposed to during attachment to the building structure. This saves both on the effort needed to fabricate the cornice assembly 22 and to attach the cornice assembly 22 to the building structure.

The cornice assemblies and trim members of the present invention are preferably manufactured through the process of pultrusion. Pultrusion is an economical technique which is especially suited for the manufacture of cornice assemblies and other trim members because they have uniform cross-sections and also benefit from the high strength to weight ratio provided by pultrusion.

Figure 3:
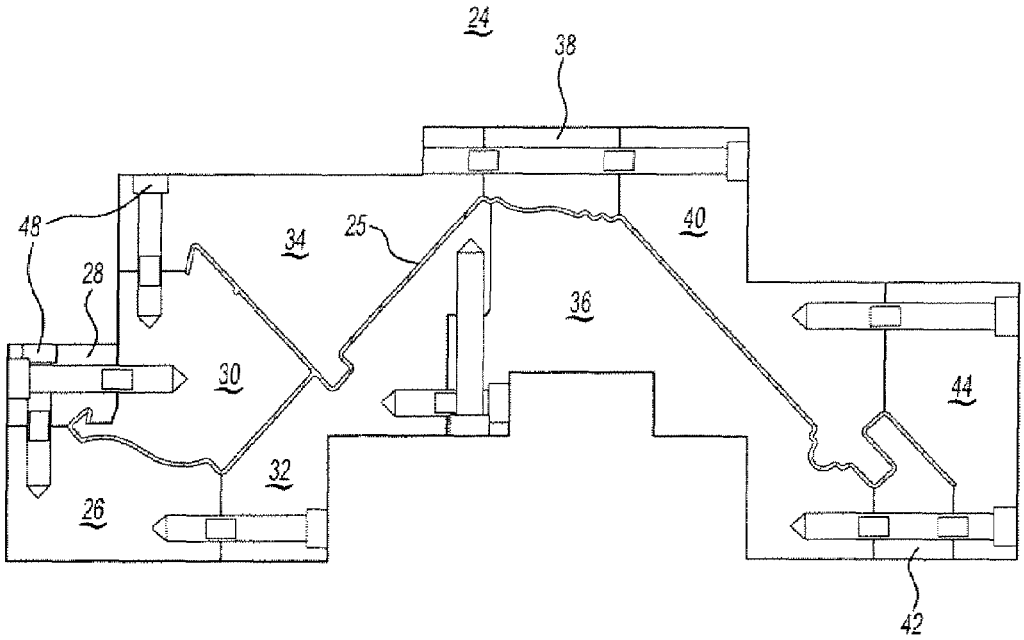
FIG. 3 is a pultrusion die with a channel for a unitary construction cornice assembly with a facia, a soffit, a crown, a frieze and a gutter.
Figure 4:
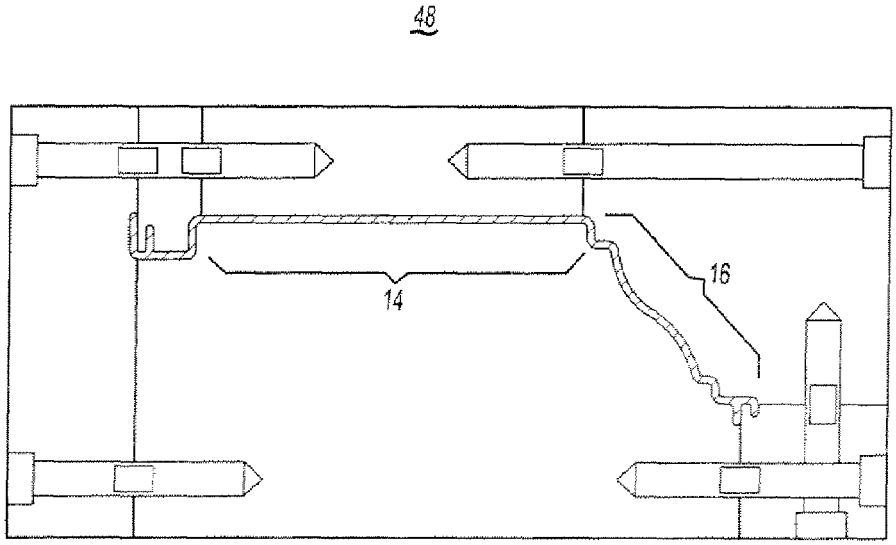
FIG. 4 is a pultrusion die for a trim member including a soffit and a crown.
Figure 5:
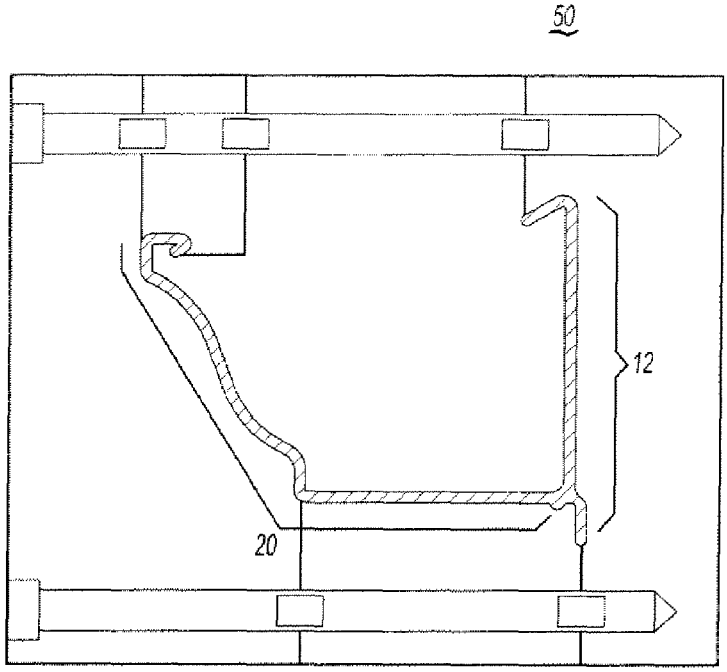
FIG. 5 is a pultrusion die for a trim member including a facia and a gutter.
Figure 6:
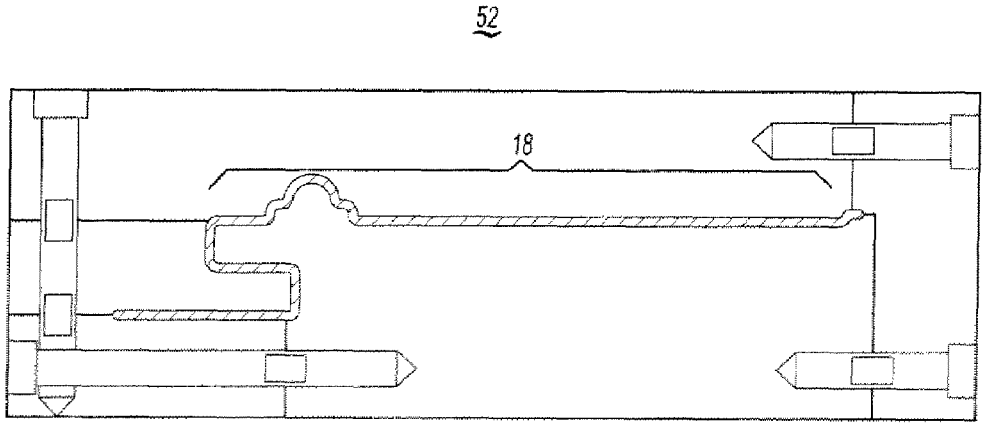
FIG. 6 is a pultrusion die for a trim member including a frieze.
Figure 7:
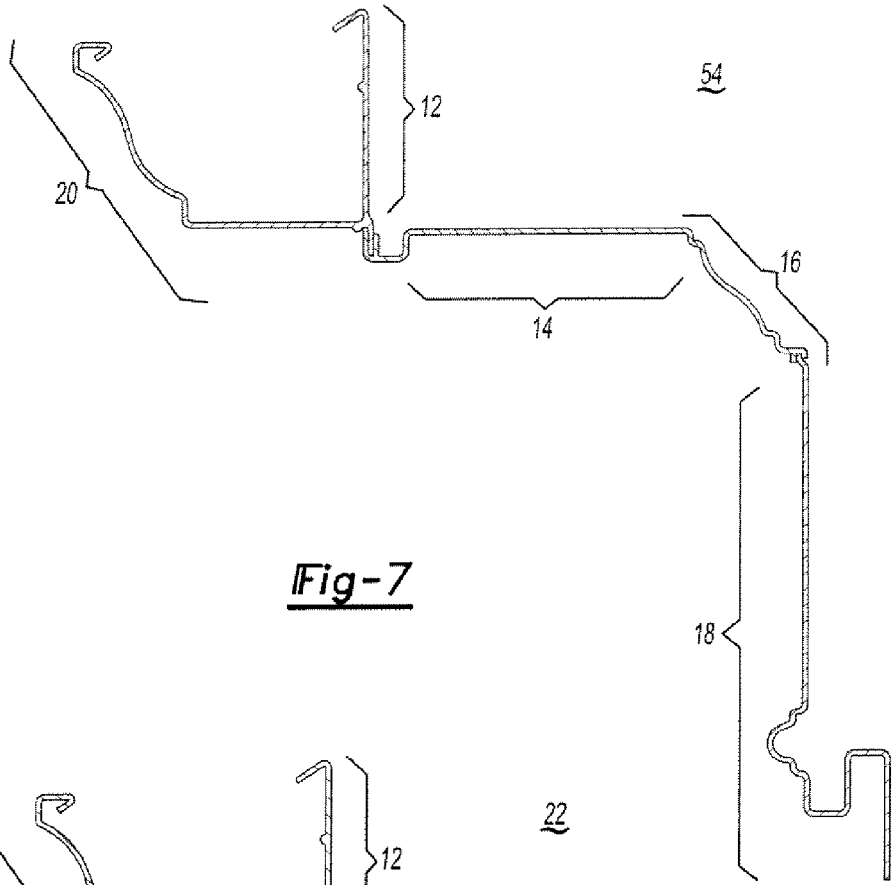
FIG. 7 is a cross-section of a cornice assembly made of three trim members.

Of importance to the pultrusion process is the die through which the resin impregnated reinforcements are pulled. Die include multiple metal blocks, which, when assembled, has a through-hole or channel in the shape of the desired cross-section of the trim member. FIG. 3 shows a die 24 with a channel 25 which would be used to manufacture an entire cornice assembly in a unitary construction. As can be seen, a total of ten different blocks 26-44 make up the die 24 for the unitary construction of the cornice assembly. The various blocks of the die 24 are held together with bolts, screws or other suitable fasteners 46. FIG. 4 shows a die 48 which is used to manufacture a portion of a cornice assembly including a soffit 14 and a crown 16. The soffit/crown trim member made with die 48 would be connected to a trim member including a gutter 20 and a facia 12 made with die 50, shown in FIG. 5, and to a trim member including a frieze 18 made with die 52, shown in FIG. 6. Together the trim members created by these die 48, 50 and 52 would fit together to form a cornice assembly 54, shown in FIG. 7.

Selection of the particular resin and reinforcements that may be used in the pultrusion of cornice assemblies and trim members are well within the design capability of those skilled in the art. Exemplary reinforcements include continuous strands of fiberglass, aramid fibers, and graphite. In addition, chopped strand, continuous strand or swirl mats may also be used as reinforcements. A useful reinforcement is glass fiber because it is economically priced as compared to other fibers, such as carbon fibers, and has a high strength to weight ratio. Exemplary resin include polyurethane, polyesters, vinyl esters, epoxy resins, acrylic and phenolic resins.

Figure 8:
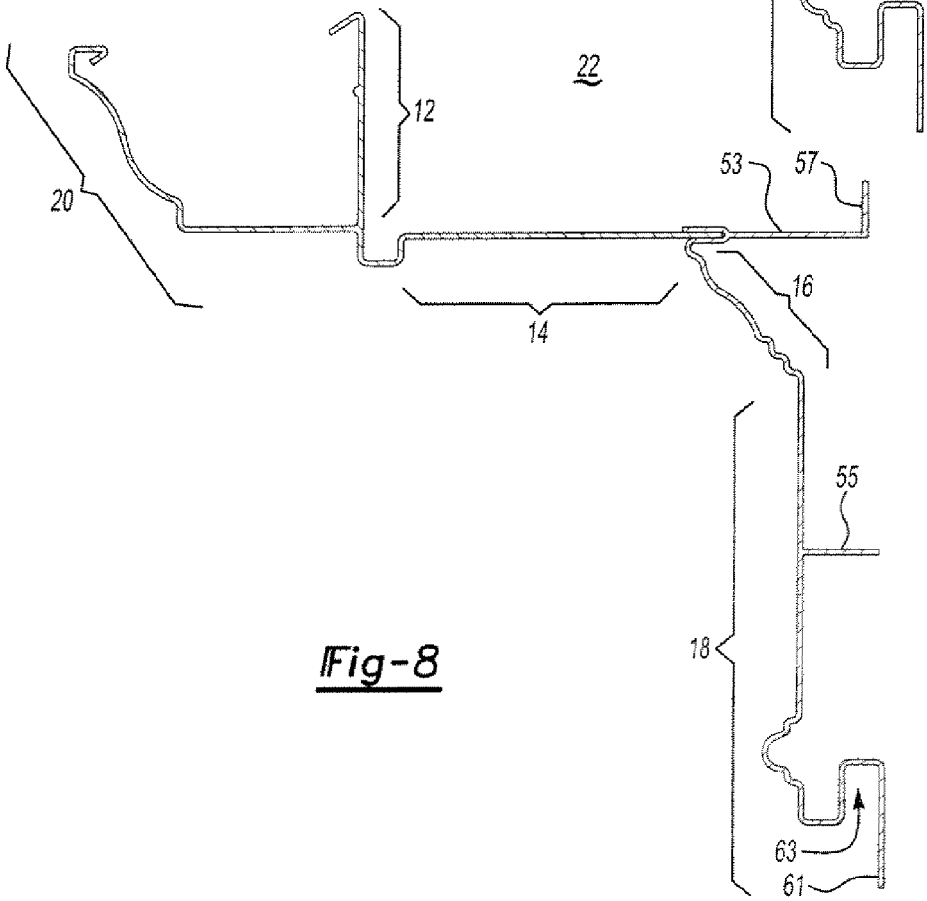
FIG. 8 is a cross-section of a cornice assembly made of two trim members.

One or more stiffening ribs may be attached to the building structure side of the cornice assemblies and trim members. In FIG. 8, stiffening rib 55 included in a two piece cornice assembly made of a trim member with a gutter 20, a facia 12 and a soffit 14 and a trim member with a crown 16 and a frieze 18. These stiffening ribs maybe pultruded from the same die as the cornice assemblies or trim members. The stiffening ribs provide extra support for the cornice assemblies and trim members against forces applied there against. This bracing prevents damage which may result from the placement of ladders against the cornice assemblies and trim members, particularly placement of ladders at the frieze 18. Furthermore, nailers 57, 61, which form a nailing surface for nailing the cornice assembly or trim member to the building structure.

Figure 9:
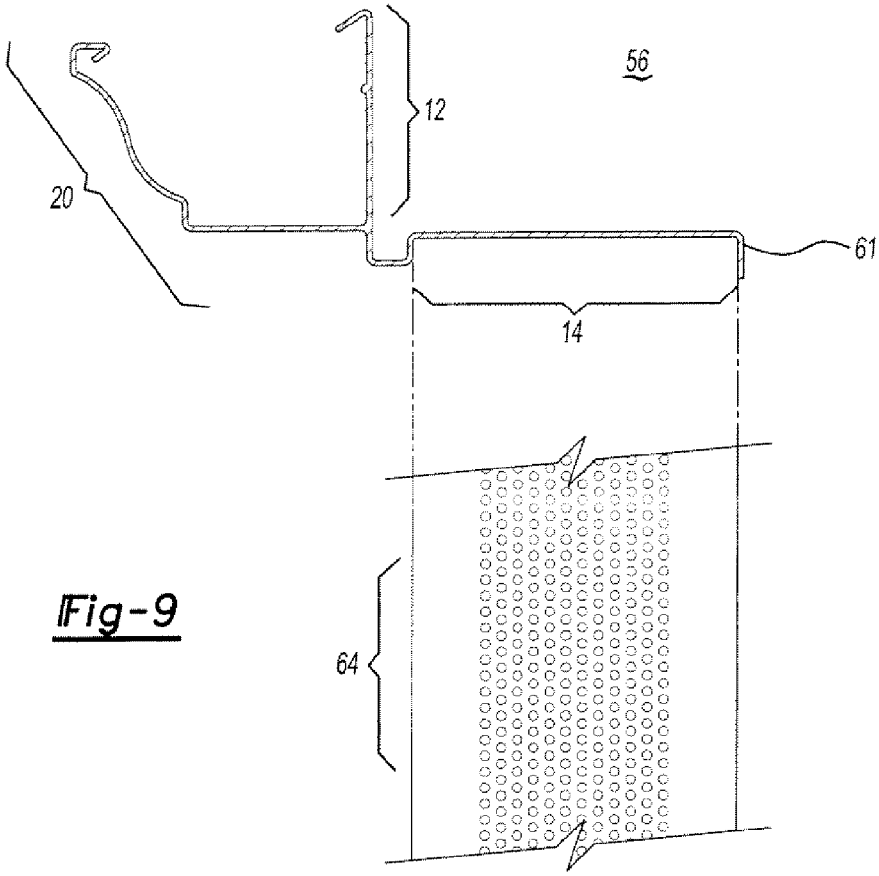
FIG. 9 is a cross-section of a trim member including a facia, a soffit and a gutter and a longitudinal section of the soffit including an area of vent holes.
Figure 10:
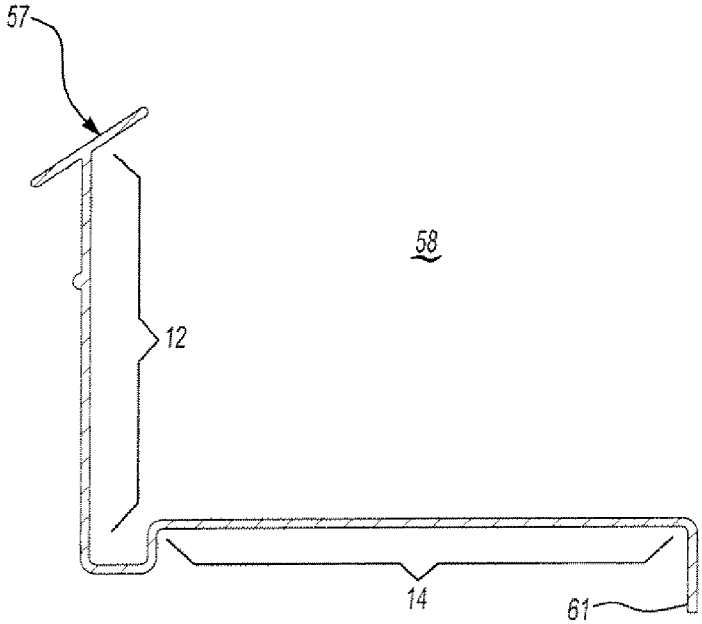
FIG. 10 is a cross-section of a trim member including a facia and a soffit without gutter.
Figure 11:
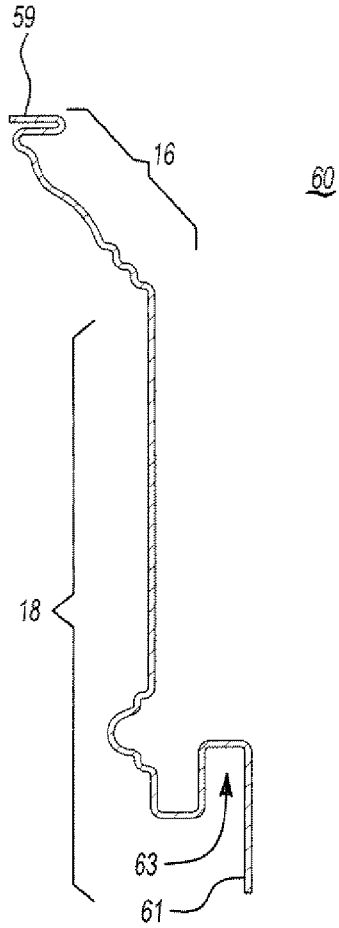
FIG. 11 is a cross-section of a trim member including a crown and a frieze where the frieze includes a slotted opening to receive wood, metal or vinyl siding.
Figure 12:
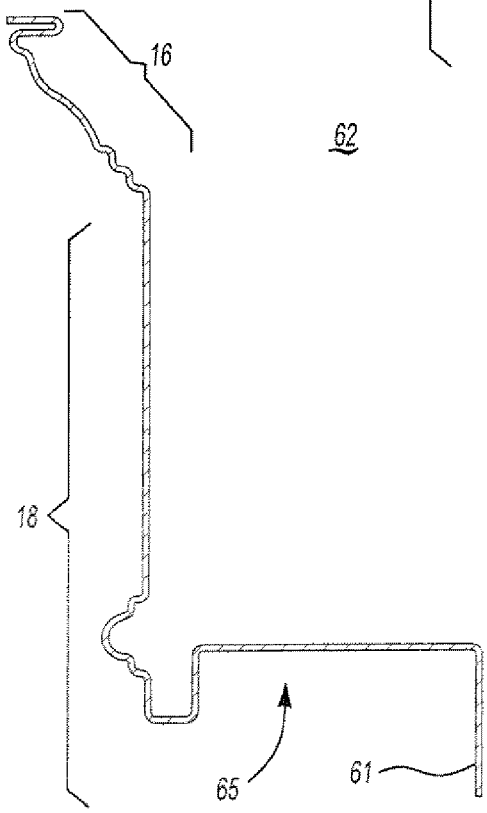
FIG. 12 is a cross-section of a trim member including a crown and a frieze where the frieze includes a slotted opening to receive brick veneer.

The available cross-sections for trim members is unlimited. Exemplary crosssections, in addition to the ones previously shown with regard to the die 48-52, include a trim member 56 which includes a gutter 20, a facia 12 and a soffit 14 shown in FIG. 9, a trim member 58 which includes a facia 12 and a soffit 14 shown in FIG. 10, a trim member 60 which includes a crown 16 and a frieze 18 (adapted for use with exterior sheet siding) shown in FIG. 11. shown in FIG. 12. The friezes shown in FIGS. 8 and 11 show a relatively narrow channel 63 for accepting exterior sheet siding (such as aluminum, vinyl, wood, or the like). The frieze shown in FIG. 12 has a relatively wide channel 65 designed to accept brick or stone veneering. The trim members 56-62 may be mixed and matched to achieve the desired cornice assembly.

Figure 13A:
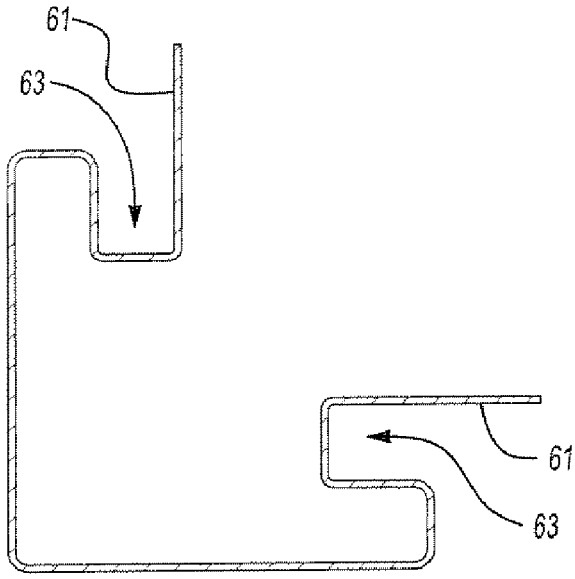
FIG. 13A is a cross-section of a outside edge cap trim member.
Figure 13B:
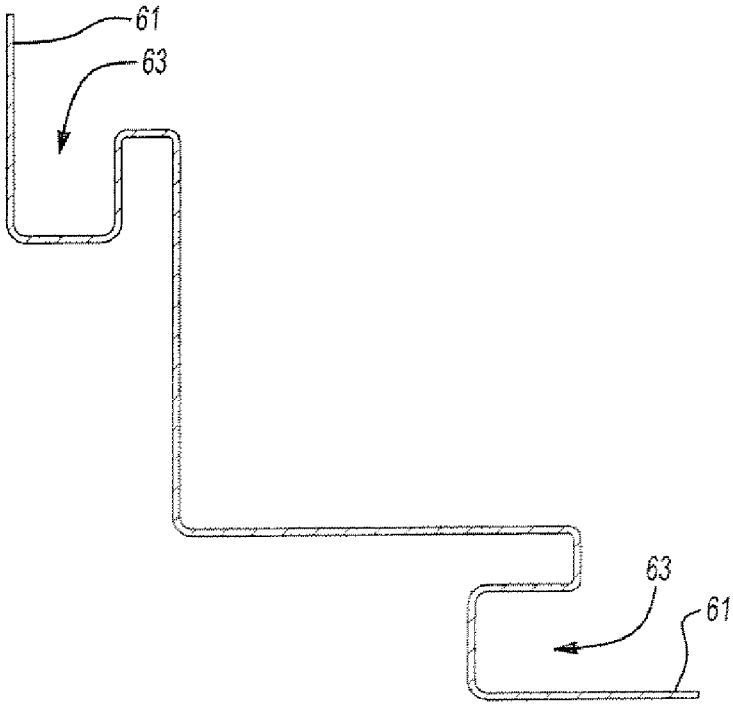
FIG. 13B is a cross section of an inside edge cap.
Figure 14:
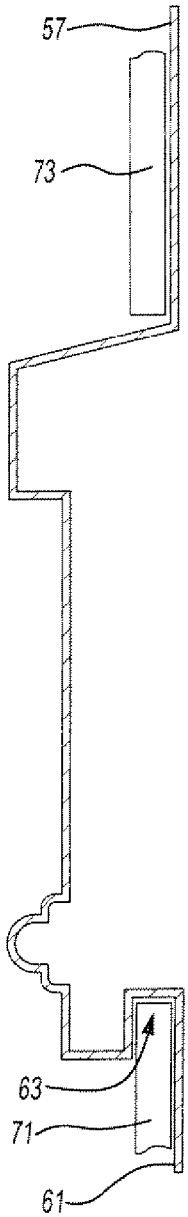
FIG. 14 is a cross-section of a belt board trim member.
Figure 15:
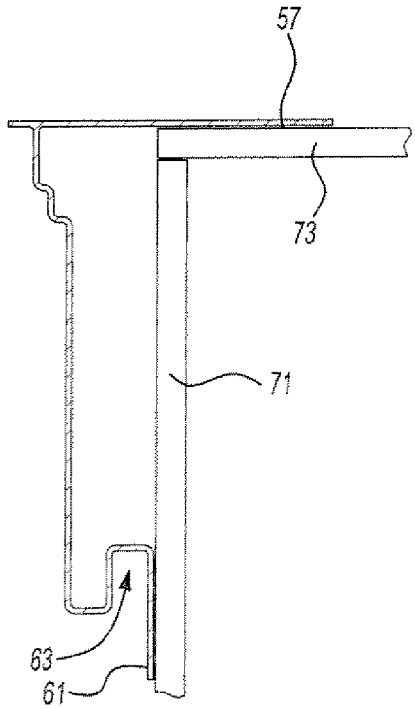
FIG. 15 is a cross-section of a rake trim member.

Other trim members which may be pultruded include caps for covering vertical edges, as shown in FIG. 13A, which are used to cover an outside edge cap where two pieces of siding come together. Belt boards as shown in FIG. 14, which are used to transition from one siding material 71 to another FIG. 13B shows an inside edge cap. One trim member which may be pultruded is a rake, which is used along the gable side of the intersection between the siding material 71 and the roof deck 73, as seen in FIG. 15.

One or more vent holes may be made in the soffit allow circulation of air and escape of moisture. These vent holes may be made shortly after the time of fabrication of the pultruded member or at the job site, as dictated by the needs of the installer. Vent holes 64 in the soffit 14, are shown in a longitudinal view of the soffit portion 14 of trim member 56 in FIG. 9.

Preferably, the method of attaching the trim members to each other are press fit connections 59, as best seen in FIG. 11, because such fasteners are easily constructed during the pultrusion process. However, because of the thermal stability of pultruded members, any fastening means may be used without concern about the expansion and contraction due to variations in temperature or moisture. Cornice assemblies and trim member manufactured via pultrusion expand and contract less than $1/26^{th}$ of that of steel over a given temperature range. Thus, fasteners will not be sheared by pultruded cornice assemblies and trim members.

Various fastening slots are needed in aluminum and vinyl siding trim members to facilitate expansion and contraction that occurs after installation around the fastening nail after installation. However, such fastening slots are not necessary with pultruded members because, as discussed above, the pultruded cornice assemblies and trim members of the present invention do not expand or contract due to changes in temperature or moisture. Thus, when fastening pultruded cornice assemblies to building structures, the step of having to form slots can be eliminated. Also, trim members made from aluminum or vinyl and more difficult to install than pultruded members because they cannot be firmly nailed to the sheathing but must be loosely nailed so that they literally "hang" from the mounting nails by way of the slots. Pultruded members can be nailed firm just like wood can be nailed to other wood.

Because the pultruded cornice assemblies and trim members of the present invention have superior rigidity and strength to weight ratios, a significantly fewer fasteners are needed to attach the cornice assemblies and trim members to building structures.

In combination with the pultruded cornice assemblies of the present invention and other trim members, a variety of butt joint caps, corner caps, and end caps may be used to complete the trimming of a building structure. Butt joint caps are used to bridge the area where two linear sections of a cornice assembly or trim member come together.

Corner caps are used to bridge the area where two linear section of a cornice assembly or trim members come together at a corner. Both inside and outside corners are needed. While not suitable for manufacturing by pultrusion, butt joint, end, and corner caps may cost effectively be manufactured by other conventional methods such as foam injection, plastic injection, urethane casting, and the like. Caps are preferably attached with two-sided tape.

End caps are used to close off the ends of cornice assemblies and trim members to prevent dirt and water from penetrating behind the cornice assembly and potentially damaging the building structure.

While the invention has been specifically described in connection with certain specific embodiments thereof, it is to be understood that this is by way of illustration and not of limitation, and the scope of the appended claims should be construed as broadly as the prior art will permit.

What is claimed is:

1. A method for making a trim member for a building structure, comprising the steps of:

a) impregnating a plurality of fibers with a resin; and b) pultruding the resin impregnated fibers through a pultrusion die for pultruding a cornice assembly including:

a. a pultruded frieze with a forward portion, a rearward portion, a lower end portion and an upper end portion, the lower end portion including a wall that terminates at a lower wall end with a first horizontally disposed substantially flat segment, and folds back upon itself in the rearward portion in a single integrated structure, in a generally serpentine manner, upwardly from the first horizontally disposed substantially flat segment of the lower wall end with a first vertically disposed substantially flat segment that projects partially toward the upper end portion, and then adjoins a second horizontally disposed substantially flat segment that projects rearwardly, with the second horizontally disposed substantially flat segment terminating at a second vertically downward disposed substantially flat segment, the second vertically downward disposed substantially flat segment thereby forming both (a) a first nailing surface in the rearward portion and (b) a frieze channel that extends above the lower wall end for receiving a siding or brick or stone veneering so that upon fastening the frieze to an underlying surface at the rearward portion first nailing surface with a fastener, and upon insertion of the siding or brick or stone veneering, the fastener is concealed from view;

b. a generally vertically disposed pultruded facia that includes a substantially straight wall and is located at an elevation higher than the frieze;

c. a gutter that adjoins the facia and includes the facia as a rearward wall of the gutter;

d. a pultruded crown with a lower end portion integrally adjoining the upper end portion of the frieze, and an upper end portion, the crown including an outer surface for simulating an ornate crown molding that includes a generally undulating surface contour, the crown being located at an elevation below the gutter;

e. a pultruded soffit that is generally horizontally disposed between the crown and the gutter piece, is integrally formed with the facia and the gutter, and projects away from the upper end portion of the crown;

f. a generally U-shaped pultruded structure that defines a crown channel integrally formed at the upper end portion of the crown into which the pultruded soffit and gutter piece is joined; and g. a pultruded wall that projects rearwardly from the upper end portion of the crown, and includes an upwardly projecting segment for defining a second nailing surface that is generally juxtaposed with the gutter, is generally parallel with the facia, and is also generally co-linear with the first nailing surface; and c) fabricating the cornice assembly at ground level;

wherein the pultruded construction expands and contracts less than the expansion or contraction of steel over a given temperature range.

2. A method for making a trim member for a building structure, comprising the steps of:

a) impregnating a plurality of fibers with a resin; and b) pultruding the resin impregnated fibers through a pultrusion die for pultruding a thermally stable, pultruded construction including:

a. a pultruded frieze with a first end portion and a second end portion, the pultruded frieze including a wall that folds back upon itself from the first end portion of the frieze for forming both a nailing surface and a frieze channel for accepting a siding or brick or stone veneering, so that upon fastening the pultruded frieze to an underlying surface at the nailing surface, and upon insertion of the siding or brick or stone veneering, the fastener can be concealed from view;

b. a pultruded crown with a first end portion integrally adjoining the second end portion of the frieze, and a second end portion, further comprising a wall that projects rearwardly from the second end portion of the crown, and includes an upwardly projecting portion for defining a second nailing surface.

c. a pultruded soffit;

d. a pultruded gutter and a facia integrally formed with the pultruded soffit, wherein the pultruded soffit has a plurality of vent holes defined therein, and the pultruded soffit is attached to the pultruded crown so that it is generally horizontally disposed and projects away from the second end portion of the pultruded crown further wherein the facia forms the back side of the pultruded gutter;

wherein the pultruded construction is thermally stable so that it expands and contracts less than the expansion or contraction of steel over a given temperature range and further wherein the pultruded construction is fabricated at ground level;

and further wherein the surface of the pultruded construction can accept and permanently retain paint, is resistant to rot, and is resistant to indentation.

3. A method for making a trim member for a building structure, comprising the steps of:

a) impregnating a plurality of fibers with a resin; and b) pultruding the resin impregnated fibers through a pultrusion die for pultruding a construction including:

a. a pultruded frieze with a forward portion, a rearward portion, a lower end portion and an upper end portion, the lower end portion including a wall that terminates at a lower wall end and folds back upon itself, in a continuous generally serpentine manner, upwardly from the lower wall end toward the upper end portion, then rearwardly and then downwardly, for forming both (a) a first nailing surface in the rearward portion and (b) a frieze channel that extends above the lower wall end for receiving a siding or brick or stone veneering;

b. a pultruded crown with a first end portion integrally adjoining the upper end portion of the pultruded frieze, and a second end portion, the pultruded crown including an outer surface for simulating an ornate crown molding that includes a generally undulating surface contour; wherein at least a portion of the frieze channel is disposed so that upon fastening the pultruded frieze to an underlying surface at the rearward portion nailing surface with a fastener, and upon insertion of the siding or brick or stone veneering, the fastener is concealed from view;

c. a pultruded soffit and gutter sub-assembly joining with the pultruded crown d. a wall that projects rearwardly from the second end portion of the pultruded crown, and includes an upwardly projecting portion for defining a second nailing surface that is generally juxtaposed with an upwardly projecting forward wall of the gutter of the soffit and gutter sub-assembly, and is also generally co-linear with the first nailing surface; and wherein the pultruded construction expands and contracts less than the expansion or contraction of steel over a given temperature range;

and further wherein the surface of the pultruded construction can accept paint, is resistant to rot, and is resistant to indentation.

4. A method for making a trim member for a building structure, comprising the steps of:

a) impregnating a plurality of fibers with a resin; and b) pultruding the resin impregnated fibers through a pultrusion die for pultruding a construction including:

a. a pultruded frieze with a forward portion, a rearward portion, a lower end portion and an upper end portion, the lower end portion including a wall that terminates at a lower wall end and folds back upon itself, in a continuous generally serpentine manner, upwardly from the lower wall end toward the upper end portion, then rearwardly and then downwardly, for forming both (a) a first nailing surface in the rearward portion and (b) a frieze channel that extends above the lower wall end for receiving a siding or brick or stone veneering;

b. a pultruded crown with a first end portion integrally adjoining the upper end portion of the pultruded frieze, and a second end portion, the pultruded crown including an outer surface for simulating an ornate crown molding that includes a generally undulating surface contour; wherein at least a portion of the frieze channel is disposed so that upon fastening the pultruded frieze to an underlying surface at the rearward portion nailing surface with a fastener, and upon insertion of the siding or brick or stone veneering, the fastener is concealed from view;

c. a pultruded soffit and gutter sub-assembly joining with the pultruded crown d. a wall that projects rearwardly from the second end portion of the pultruded crown, and includes an upwardly projecting portion for defining a second nailing surface that is generally juxtaposed with an upwardly projecting forward wall of the gutter of the soffit and gutter sub-assembly, and is also generally co-linear with the first nailing surface; and wherein the trim member is fabricated at ground level;

further wherein the pultruded construction expands and contracts less than the expansion or contraction of steel over a given temperature range; and further wherein the surface of the pultruded construction can accept paint, is resistant to rot, and is resistant to indentation.

5. A method for making a trim member for a building structure, comprising the steps of:

a) impregnating a plurality of fibers with a resin; and b) pultruding the resin impregnated fibers through a pultrusion die for pultruding a construction including:

a. a pultruded frieze with a forward portion, a rearward portion, a lower end portion and an upper end portion, the lower end portion including a wall that terminates at a lower wall end and folds back upon itself, in a continuous generally serpentine manner, upwardly from the lower wall end toward the upper end portion, then rearwardly and then downwardly, for forming both (a) a first nailing surface in the rearward portion and (b) a frieze channel that extends above the lower wall end for receiving a siding or brick or stone veneering;

b. a pultruded crown with a first end portion integrally adjoining the upper end portion of the pultruded frieze, and a second end portion, the pultruded crown including an outer surface for simulating an ornate crown molding that includes a generally undulating surface contour, further wherein the pultruded crown has a generally U-shaped structure that defines a crown channel at the second end portion into which a pultruded soffit and gutter sub-assembly is press-fit, further wherein the pultruded crown comprising a wall that projects rearwardly from the second end portion of the pultruded crown, and includes an upwardly projecting portion for defining a second nailing surface;

c. the pultruded soffit and gutter sub-assembly joining with the pultruded crown; and d. wherein at least a portion of the frieze channel is disposed so that upon fastening the pultruded frieze to an underlying surface at the rearward portion nailing surface with a fastener, and upon insertion of the siding or brick or stone veneering, the fastener is concealed from view;

wherein the trim member is fabricated at ground level;

wherein the pultruded construction expands and contracts less than the expansion or contraction of steel over a given temperature range;

and further wherein the surface of the pultruded construction can accept paint, is resistant to rot, and is resistant to indentation.

6. A method for making a trim member for a building structure, comprising the steps of:

a) impregnating a plurality of fibers with a resin; and b) pultruding the resin impregnated fibers through a pultrusion die for pultruding a construction including:

a. a pultruded frieze with a forward portion, a rearward portion, a lower end portion and an upper end portion, the lower end portion including a wall that terminates at a lower wall end and folds back upon itself, in a continuous generally serpentine manner, upwardly from the lower wall end toward the upper end portion, then rearwardly and then downwardly, for forming both (a) a first nailing surface in the rearward portion and (b) a frieze channel that extends above the lower wall end for receiving a siding or brick or stone veneering;

b. a pultruded crown with a first end portion integrally adjoining the upper end portion of the pultruded frieze, and a second end portion, the pultruded crown including an outer surface for simulating an ornate crown molding that includes a generally undulating surface contour, further wherein the pultruded crown has a generally U-shaped structure that defines a crown channel at the second end portion into which a pultruded soffit and gutter sub-assembly is press-fit, further wherein the crown comprising a wall that projects rearwardly from the second end portion of the crown, and includes an upwardly projecting portion for defining a second nailing surface;

c. the pultruded soffit and gutter sub-assembly joining with the pultruded crown;

d. a plurality of vent holes forming in the pultruded soffit and wherein the pultruded soffit is generally horizontally disposed between the crown and the gutter piece; and wherein the trim member is fabricated at ground level;

wherein at least a portion of the frieze channel is disposed so that upon fastening the pultruded frieze to an underlying surface at the rearward portion nailing surface with a fastener, and upon insertion of the siding or brick or stone veneering, the fastener is concealed from view;

wherein the pultruded construction expands and contracts less than the expansion or contraction of steel over a given temperature range; and further wherein the surface of the pultruded construction can accept paint, is resistant to rot, and is resistant to indentation.

* * * * *